US009625876B2

(12) United States Patent
Watanabe

(10) Patent No.: US 9,625,876 B2
(45) Date of Patent: Apr. 18, 2017

(54) IMAGE FORMING APPARATUS

(71) Applicant: FUJI XEROX CO., LTD., Tokyo (JP)

(72) Inventor: Kaoru Watanabe, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/810,623

(22) Filed: Jul. 28, 2015

(65) Prior Publication Data

US 2016/0266539 A1 Sep. 15, 2016

(30) Foreign Application Priority Data

Mar. 9, 2015 (JP) ..... 2015-046164

(51) Int. Cl.
*G03G 21/18* (2006.01)

(52) U.S. Cl.
CPC ..... *G03G 21/18* (2013.01)

(58) Field of Classification Search
CPC ..... G03G 21/18
See application file for complete search history.

(56) References Cited

U.S. PATENT DOCUMENTS

2005/0069338 A1* 3/2005 Oguma ..... G03G 21/1867 399/90
2005/0201773 A1* 9/2005 Matsubara ..... G03G 21/1867 399/90
2009/0245861 A1* 10/2009 Eom ..... G03G 15/0863 399/119
2012/0301173 A1* 11/2012 Eom ..... G03G 15/0863 399/90
2015/0261176 A1* 9/2015 Moon ..... G03G 21/1885 399/90

FOREIGN PATENT DOCUMENTS

JP 2004-333890 A 11/2004
JP 2007-047402 A 2/2007

* cited by examiner

*Primary Examiner* — Sevan A Aydin
(74) *Attorney, Agent, or Firm* — Sughrue Mion, PLLC

(57) ABSTRACT

An image forming apparatus includes an apparatus body, a cartridge, a storage medium, a cartridge-side holding device, a body-side holding device, and a reading device. The cartridge is attachable to and detachable from the apparatus body. Information relating to the cartridge is stored in the storage medium. The cartridge-side holding device is provided in the cartridge and, when the cartridge is in a non-inserted state in which the cartridge is not inserted into the apparatus body, holds the storage medium. The body-side holding device is provided in the apparatus body and, when the cartridge is in an attached state in which the cartridge is disposed at an operation position in the apparatus body, holds the storage medium transferred from the cartridge-side holding device. The reading device reads the information from the storage medium held by the body-side holding device.

7 Claims, 12 Drawing Sheets

IMAGE FORMING APPARATUS

CROSS-REFERENCE TO RELATED APPLICATIONS

This application is based on and claims priority under 35 USC 119 from Japanese Patent Application No. 2015-046164 filed Mar. 9, 2015.

BACKGROUND (i) Technical Field

The present invention relates to an image forming apparatus.

(ii) Related Art

Image forming apparatuses include items such as photosensitive drums and toner that need periodical replacement (or replenishment). Items that need replacement or the like are collectively disposed in cartridges in the related-art image forming apparatuses, and users such as service persons or customers who use the image forming apparatuses replace the cartridges. This allows replacement or replenishment of these items to be performed in a collective manner. Examples of the cartridges include a photosensitive body cartridge that includes a photosensitive drum and so forth, a developing cartridge that includes toner and so forth, and a process cartridge into which these cartridges are integrated.

A storage medium in which information relating to each of these cartridges is stored is attached to the cartridge. The information relating to the cartridge to which the storage medium is attached such as a model number of the cartridge and the remaining amount of toner is stored in the storage medium. An apparatus body may obtain the information by reading the information stored in the storage medium attached to the cartridge. In the related art image forming apparatuses, the storage medium is accessed from the apparatus body by bringing electrically conductive contacts included in the storage medium attached to the cartridge into contact with electrically conductive contacts provided in the apparatus body.

SUMMARY

According to an aspect of the present invention, an image forming apparatus includes an apparatus body, a cartridge, a storage medium, a cartridge-side holding device, a body-side holding device, and a reading device. The cartridge is attachable to and detachable from the apparatus body. Information relating to the cartridge is stored in the storage medium. The cartridge-side holding device is provided in the cartridge. When the cartridge is in a non-inserted state in which the cartridge is not inserted into the apparatus body, the cartridge-side holding device holds the storage medium. The body-side holding device is provided in the apparatus body. When the cartridge is in an attached state in which the cartridge is disposed at an operation position in the apparatus body, the body-side holding device holds the storage medium transferred from the cartridge-side holding device. The reading device reads the information from the storage medium held by the body-side holding device.

BRIEF DESCRIPTION OF THE DRAWINGS

Exemplary embodiment of the present invention will be described in detail based on the following figures, wherein.

DETAILED DESCRIPTION

An exemplary embodiment of the present invention will be described below with reference to the drawings.

An Outline of an Image Forming Apparatus According to an Exemplary Embodiment

Figure 1:
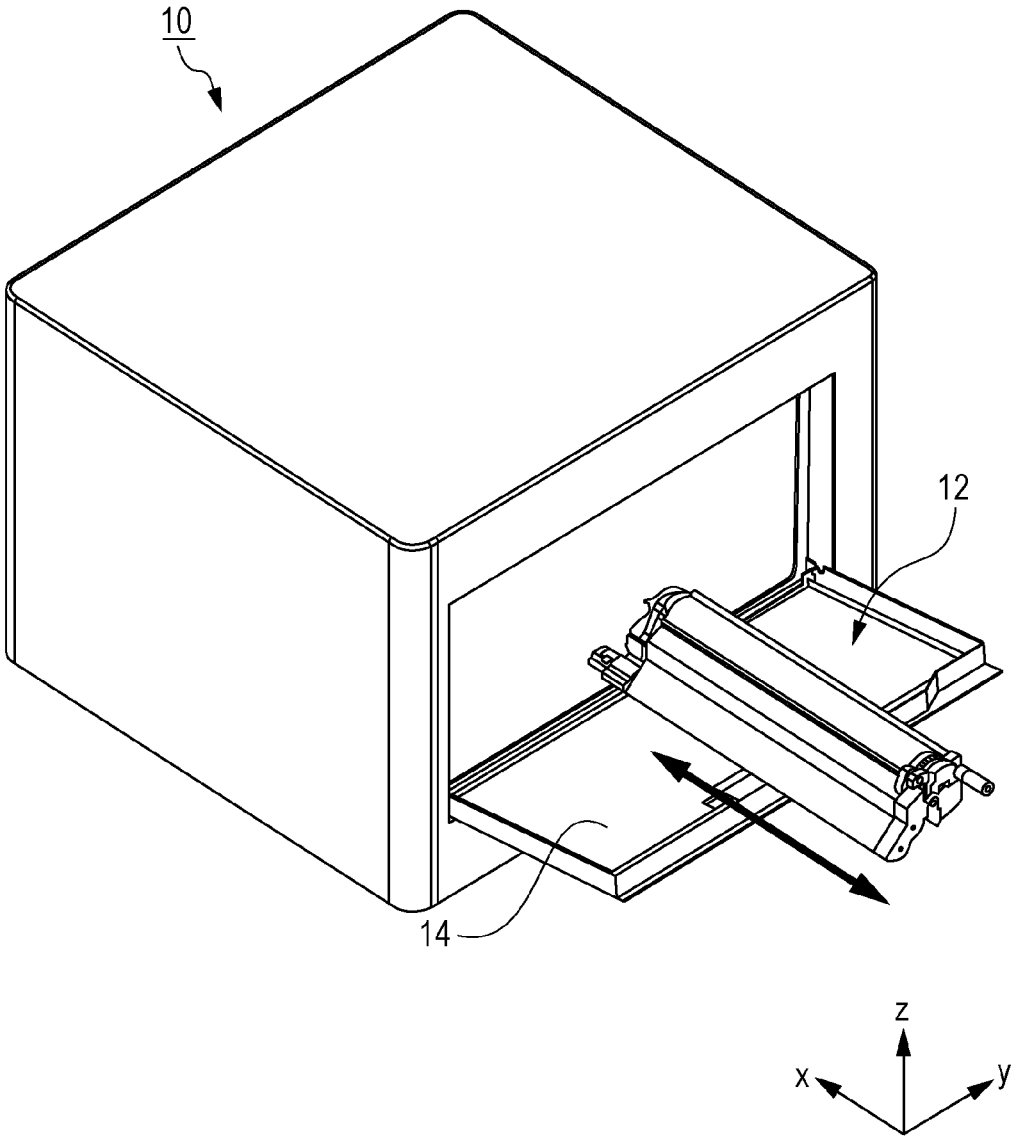
FIG. 1 is a perspective view of an outline of an image forming apparatus according to an exemplary embodiment.
Figure 2:
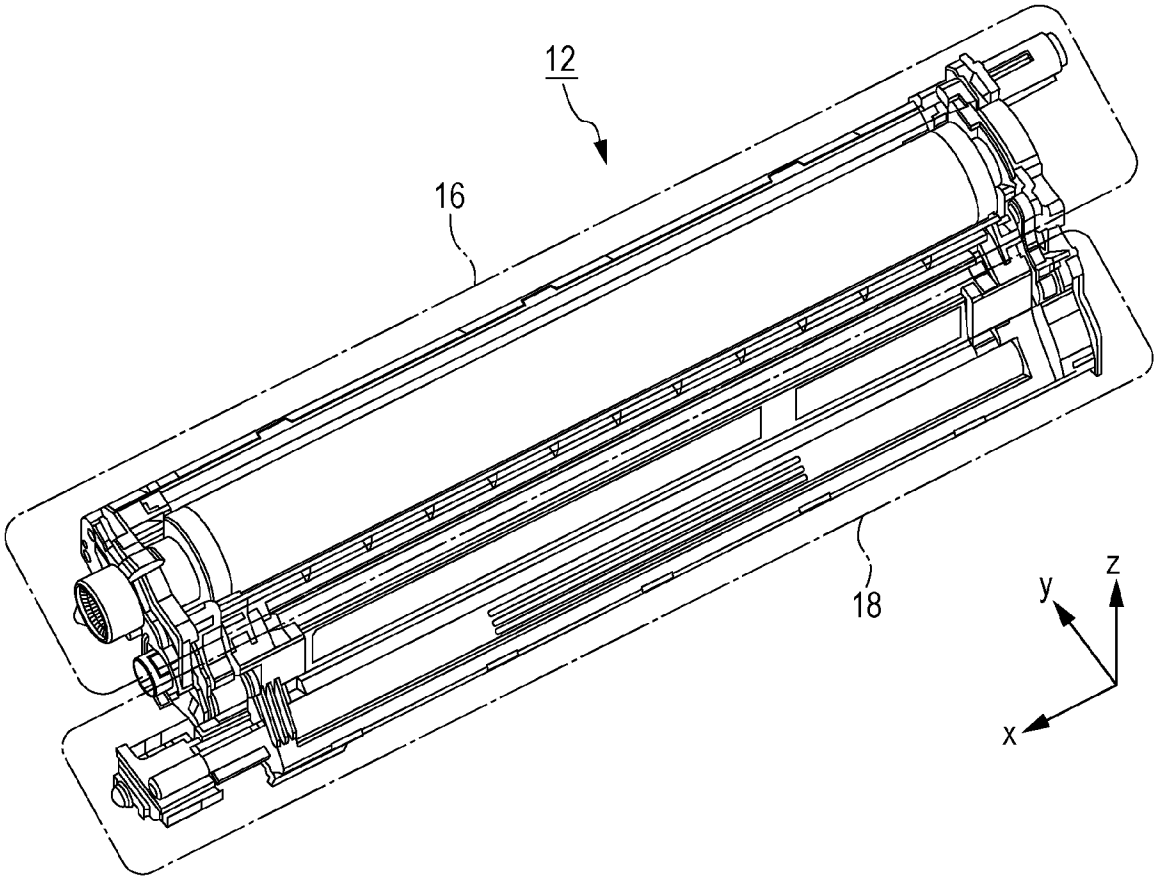
FIG. 2 is a perspective view of a process cartridge seen from above.

FIG. 1 is a schematic view of the structure of an image forming apparatus 10 according to an exemplary embodiment. FIG. 2 is a perspective view of a process cartridge seen from above. The image forming apparatus 10 is a so-called printer and includes components such as a process cartridge 12, a sheet feed tray, a sheet feed belt, a sheet feed roller, a transfer roller, a fixing roller, a power unit, and a controller. Sheets of paper that each serve as a recording medium are stored in the sheet feed tray. The sheet feed belt transports each of the sheets from the sheet feed tray. The sheet feed roller moves the sheet feed belt. A transfer roller transfers toner attracted to a photosensitive drum onto the sheet. The fixing roller fixes the toner having been transferred onto the sheet. The power unit supplies power to the components. The controller controls the components. These components cooperate with one another to perform a printing operation. Herein, the x axis extends in the left-right direction of the image forming apparatus 10, the y axis extends in the front-rear direction (depth direction) of the image forming apparatus 10, and the z axis extends in the height direction of the image forming apparatus 10.

The image forming apparatus 10 is a color printer and includes four process cartridges that respectively correspond to black, yellow, magenta, and cyan colors. Since the structures of these process cartridges are similar to one another or the same, the process cartridge 12 that is one of the process cartridges is focused in the following description. It is noted that the exemplary embodiment of the present invention is applicable not only to a color printer but also to any of a color copier, a monochrome printer, and so forth. Although the process cartridge 12 is described as an example of a cartridge detachably attached to the image forming apparatus 10 according to the present exemplary embodiment, the cartridge is not limited to the process cartridge as long as the cartridge is a member to which a memory is attached and which is detachably attached to the image forming apparatus.

The process cartridge 12 includes a photosensitive unit 16 and a developing unit 18. That is, the process cartridge 12 is a single unit that includes the photosensitive unit 16 and the developing unit 18 integrated with each other. The photosensitive unit 16 includes the photosensitive drum, a charging roller, and a cleaning blade. The charging roller charges the photosensitive drum. The cleaning blade removes residual toner from the photosensitive drum. Furthermore, the developing unit 18 includes components such as a toner storage unit, a developing roller, a waste toner storage unit, and so forth. The toner is stored in the toner storage unit. The developing roller causes the toner to be attracted to an image on the photosensitive drum. The toner removed by the cleaning blade is stored in the waste toner storage unit.

The photosensitive unit 16 and the developing unit 18 in respective attached states extend in the left-right direction (x axis direction) of the image forming apparatus 10. The process cartridge 12 includes the photosensitive unit 16 and the developing unit 18 that are arranged parallel to each other and integrated with each other. That is, the process cartridge 12 in an attached state has a substantially rod shape that also extends in the left-right direction (x axis direction) of the image forming apparatus 10.

The process cartridge 12, which is a consumable item, is required to be periodically replaced. Accordingly, the process cartridge 12 is detachably attached to the image forming apparatus 10. The process cartridge 12 is replaced by a user such as a customer who uses the image forming apparatus 10 or a service person. As illustrated in FIG. 1, attachment and detachment operations of the process cartridge 12 are performed while a side covering 14 provided in a side surface of the image forming apparatus 10 is open. The detachment operation of the process cartridge 12 is an operation in which the attached process cartridge 12 is moved rightward (toward the negative side along the x axis) so as to be pulled out. The attachment operation of the process cartridge 12 is an operation in which a new process cartridge 12 is moved leftward (toward the positive side along the x axis) to a specified printing operation position (attachment position). That is, the x axis direction is a movement direction in which the process cartridge 12 is moved during the attachment and detachment operations, and out of the positive and negative x axis directions, the positive x axis direction is a movement direction of the process cartridge 12 during the attachment operation and the negative x direction is a movement direction of the process cartridge 12 during the detachment operation.

When the process cartridge 12 has been inserted into the printing operation position in the image forming apparatus 10, the process cartridge 12 is supported by an image forming apparatus 10 body (hereafter, referred to as "apparatus body"). For example, by rotating a lock lever attached to the apparatus body after the process cartridge 12 has been pushed into the printing operation position, the process cartridge 12 is secured to the apparatus body. For ease of replacement, the process cartridge is not secured to the apparatus body by a screw or the like. Instead, the apparatus body is attachable to the apparatus body through a single operation by using the above-described lock lever or the like. The apparatus body includes members in the image forming apparatus 10 other than at least the process cartridge 12. The apparatus body includes, for example, a housing of the image forming apparatus 10 and the like that are not attached or detached by the user.

The photosensitive unit 16 side of the process cartridge 12 is supported by the apparatus body. The position of the developing unit 18 relative to the photosensitive unit 16 is made adjustable so that, for example, the developing roller is positioned relative to the photosensitive drum included in the photosensitive unit 16. In order to adjust the position, the developing unit 18 is supported by the photosensitive unit 16 instead of being supported by the apparatus body. That is, the developing unit 18 is supported by the apparatus body not directly but through the photosensitive unit 16 interposed therebetween.

Figure 3:
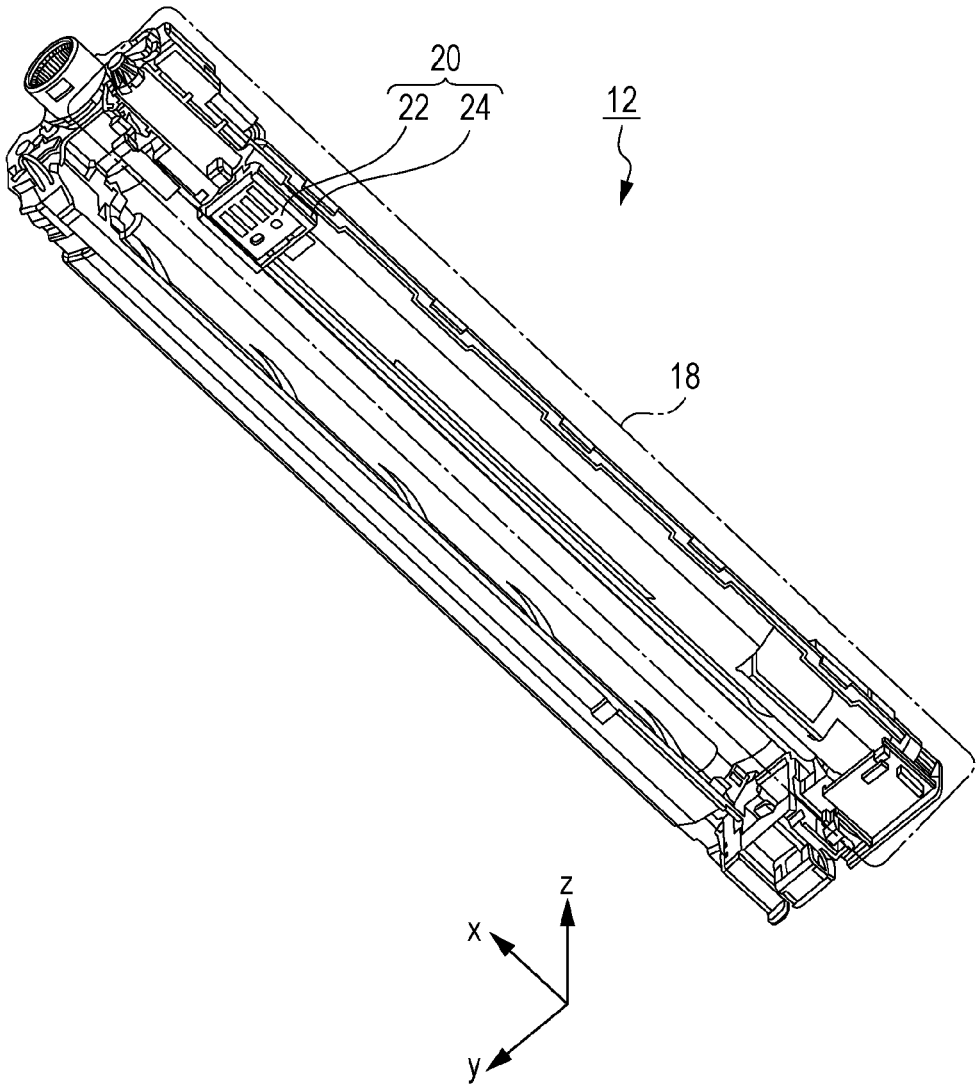
FIG. 3 is a perspective view of the process cartridge seen from below.

FIG. 3 is a perspective view of the process cartridge 12 seen from below. As illustrated in FIG. 3, a memory unit 20 is attached to a surface of the process cartridge 12.

The memory unit 20 includes a memory 22 and a memory holder 24 that protects the memory 22. The memory 22 is a nonvolatile storage medium such as a read-only memory (ROM), a random-access memory (RAM), or the like. Information relating to the process cartridge 12, for example, information about a model number of the process cartridge 12, the remaining amount of toner, and so forth is stored in the memory 22.

The memory holder 24 is formed of, for example, resin or the like and protects the memory 22. At least in operations according to the present exemplary embodiment, the memory 22 is integrated with the memory holder 24 without being removed from the memory holder 24.

In order not to allow the memory unit 20 to drop due to, for example, gravity, a holding unit (not illustrated in FIG. 3, referred to as "cartridge-side holding unit" hereafter) that holds the memory unit 20 is provided in the process cartridge 12. According to the present exemplary embodiment, the cartridge-side holding unit is attached to a bottom surface of the developing unit 18 of the process cartridge 12, the bottom surface being substantially parallel to the xy plane. The memory unit 20 is attached at a position projecting from a bottom surface of the process cartridge 12. The memory unit 20 is not necessarily attached to the bottom surface. The memory unit 20 may be disposed on any one of surfaces in the movement direction of the process cartridge 12 during the attachment and detachment operations of the process cartridge 12 in accordance with arrangement of the process cartridge 12 relative to the apparatus body or the shape or the like of the process cartridge 12 itself. Despite this, as will be described later, in order to allow the memory unit 20 to be transferred to the apparatus body side, the memory unit 20 is held at a position projecting from the surface of the process cartridge 12. The detailed structure of the cartridge-side holding unit will be described later with reference to, for example, FIGS. 5A and 5B.

The Structure of the Memory Unit

Figure 4A:
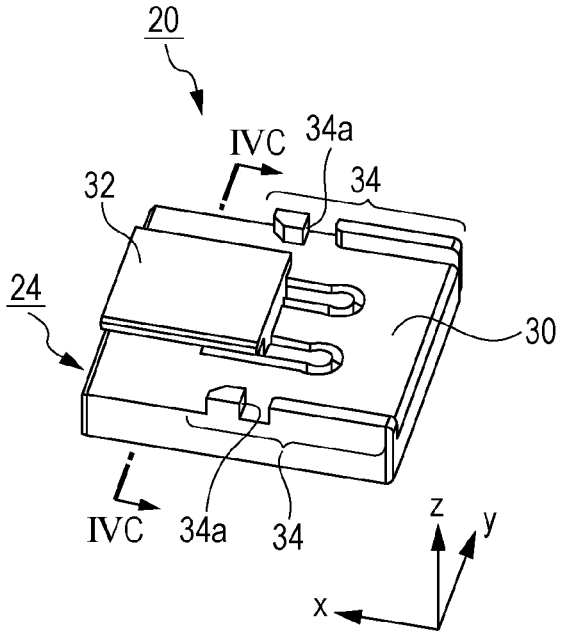
FIGS. 4A to 4C are perspective views and a sectional view of a memory unit.
Figure 4B:
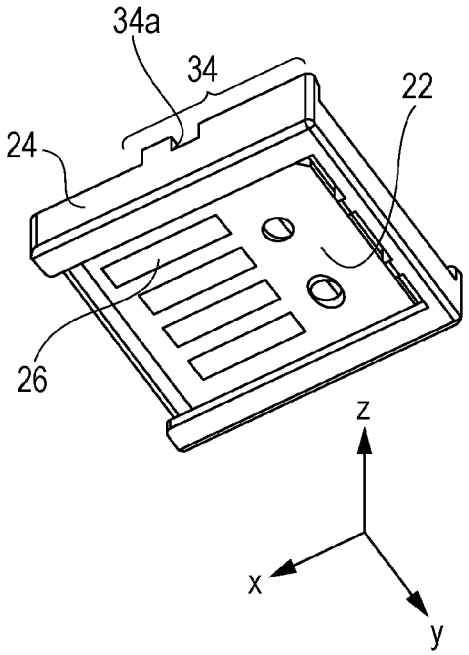
Figure 4C:
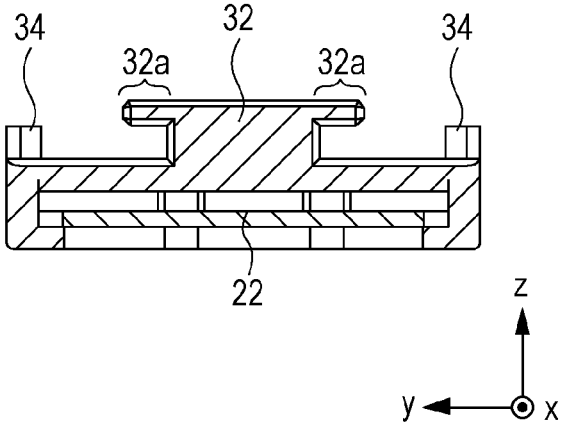

FIGS. 4A to 4C are perspective views and a sectional view of the memory unit 20. FIG. 4A is the perspective view of the memory unit 20 seen from above, FIG. 4B is the perspective view of the memory unit 20 seen from below, and FIG. 4C is a sectional view of the memory unit 20 taken along line IVC-IVC in FIG. 4A. According to the present exemplary embodiment, the memory unit 20, which is attached to the bottom surface of the process cartridge 12, is held by the cartridge-side holding unit in a direction in which an upper surface 30 of the memory unit 20 faces the bottom surface of the process cartridge 12.

A projection 32 is provided on the upper surface 30 of the memory unit 20. The projection 32 has a substantially T shape in a yz section, that is, in a section perpendicular to the movement direction of the process cartridge 12 during the attachment and detachment operations.

As will be described later, by hooking flange portions 32*a* (see FIG. 4C) of the projection 32 onto the cartridge-side holding unit so as to be held by the cartridge-side holding unit, the memory unit 20 is held by the process cartridge 12 such that the memory unit 20 is suspended from the process cartridge 12. With this structure, by moving the memory unit 20 in the x axis direction relative to the process cartridge 12, the memory unit 20 is released from a held state in which the memory unit 20 is held by the cartridge-side holding unit. Accordingly, in order to reduce a movement distance of the memory unit 20 when the memory unit 20 is released from the held state, the length of the projection 32 in the x axis direction is reduced to the extent of allowing the memory unit 20 to be held. According to the present exemplary embodiment, the length of the projection 32 in the x axis direction is about a half of the entire length of the memory unit 20.

Wall-shaped side wall portions 34 that project upward from the upper surface 30 are provided along both ends, the ends being located in the y axis direction (direction perpendicular to the movement direction of the process cartridge 12 during the attachment and detachment operations) of the upper surface 30 of the memory unit 20. That is, the side wall portions 34 extend in the x axis direction. Notch portions 34*a* are formed in the side wall portions 34 so as to penetrate through the side wall portions 34 in the y axis direction. As will be described later, the notch portions 34*a* are part of a lock mechanism that limits the movement of the memory unit 20 in the x axis direction relative to the process cartridge 12.

Figure 5A:
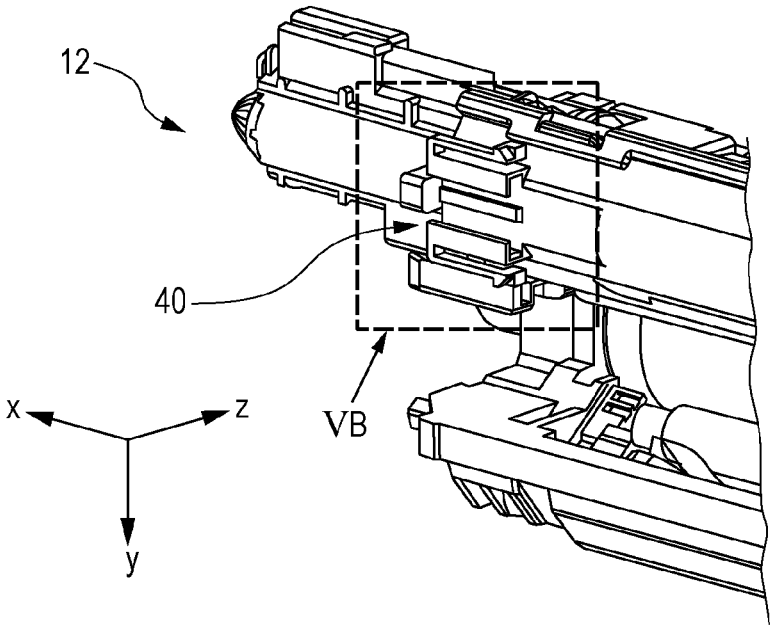
FIGS. 5A and 5B are perspective views of a process cartridge-side holding unit.
Figure 5B:
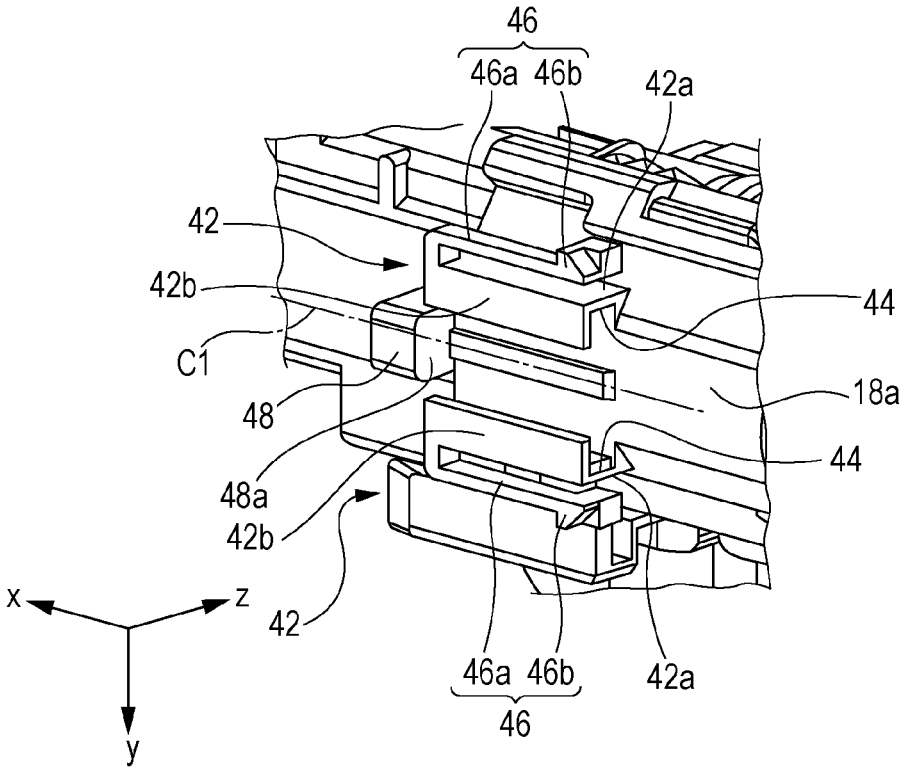

As illustrated in FIG. 4B, the memory 22, which is not covered, is disposed on a bottom surface of the memory unit 20. Plural contacts 26 are provided in the bottom surface of the memory 22. The information stored in the memory 22 is read by contact of the plural contacts 26 with contacts of a reading unit provided on the apparatus body side. The structure of the Cartridge-Side Holding Unit FIGS. 5A and 5B illustrate the structure of the cartridge-side holding unit. FIG. 5A illustrates part of the bottom surface of the process cartridge 12. FIG. 5B illustrates an enlarged view of the part of the bottom surface of the process cartridge 12 of FIG. 5A surrounded by a dotted box VB. As illustrated in FIGS. 5A and 5B, a cartridge-side holding unit 40 that holds the memory unit 20 is provided in a secured manner on the bottom surface of the process cartridge 12. Hereafter, the details of the structure of the cartridge-side holding unit 40 is described with reference to FIG. 5B.

The cartridge-side holding unit 40 includes rail portions 42, hook portions 46 provided along the rail portions 42, and a projecting block 48.

As illustrated in FIG. 5B, the rail portions 42 extend in the x axis direction, that is, in the movement direction of the process cartridge 12 during the attachment and detachment operations. The rail portions 42 each include a wall-shaped leg portion 42*a* and a plate-shaped flange portion 42*b*. The leg portion 42*a* extends in a direction substantially perpendicular to a bottom surface 18*a* of the process cartridge 12. The flange portion 42*b* extends parallel to the bottom surface 18*a* from a lower end portion of the leg portion 42*a*. That is, the rail portions 42 have an L shape in the yz section. Since the rail portions 42 have the above-described shape, groove portions 44 that have a U shape in the yz section and extend in the x axis direction are formed by the rail portions 42 and the bottom surface 18*a* of the process cartridge 12.

Two rail portions 42 are provided. Two rail portions 42 are spaced apart from each other by a specified distance in the y axis direction. Hereafter, sides in the y axis direction near a central line (dotted-chain line C1 of FIG. 5B) that extends at the center between two rail portions 42 are referred to as "y axis inner sides", and sides in the y axis direction further from the center line C1 than the y axis inner sides are referred to as "y axis outer sides". As illustrated in FIG. 5B, both of two groove portions 44 formed by two rail portions 42 are formed on the y axis inner sides of the respective leg portions 42*a*. That is, two groove portions 44 face each other.

The hook portions 46 are provided along the y axis outer sides of the respective rail portions 42. That is, there are two hook portions 46. The hook portions 46 each include an arm 46*a* and a claw 46*b*. The arm 46*a* extends in the x axis direction. The claw 46*b* is provided near a tip end of the arm 46*a* on the negative x axis direction side and projects further to a corresponding one of the y axis outer sides from a surface of the arm 46*a* on the y axis outer side. An end portion of the arm 46*a* on the positive x axis direction side is connected to an end portion of a corresponding one of the rail portions 42 on the positive x axis direction side. A gap is formed between each of the arms 46*a* and a corresponding one of the rail portions 42 in a region other than the above-described connecting region. Also, the arms 46*a* are capable of being bent to some extent.

The projecting block 48 projects downward from the bottom surface 18*a* of the process cartridge 12. Although the shape of the projecting block 48 of FIG. 5B is a substantially square rod shape, the shape of the projecting block 48 is not limited to this. The projecting block 48 is disposed further to the positive x axis direction side than the rail portions 42. Thus, as will be described later, the projecting block 48 limits the movement of the memory unit 20 held by the cartridge-side holding unit 40 toward the positive x axis direction side. Accordingly, out of surfaces of the projecting block 48, a contact surface 48*a*, which is a surface on the rail portion 42 side and in contact with the memory unit 20, is flat.

Figure 6A:
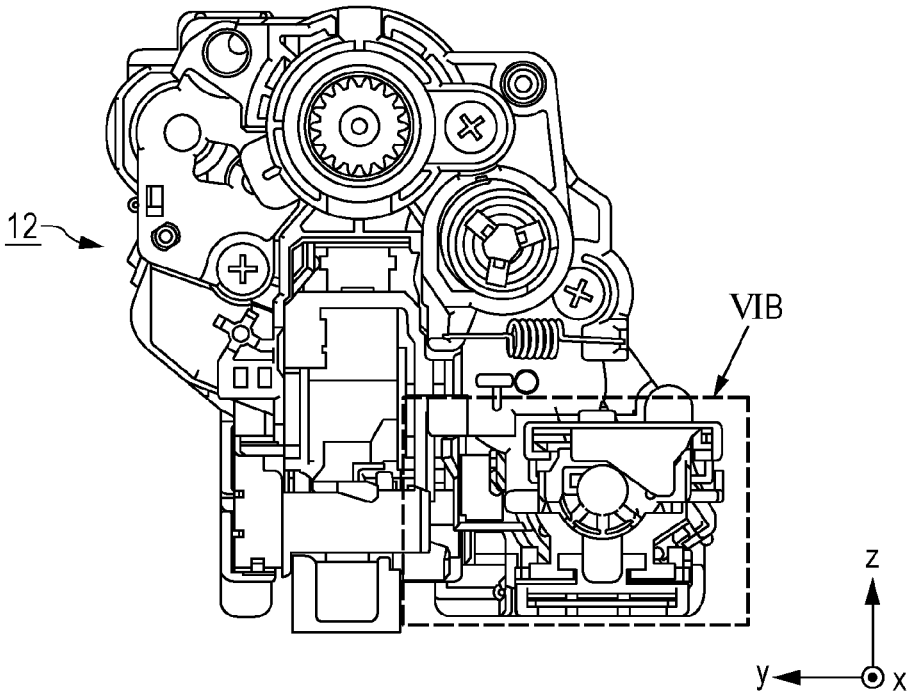
FIGS. 6A and 6B are side views of the process cartridge and the memory unit attached to the process cartridge.
Figure 6B:
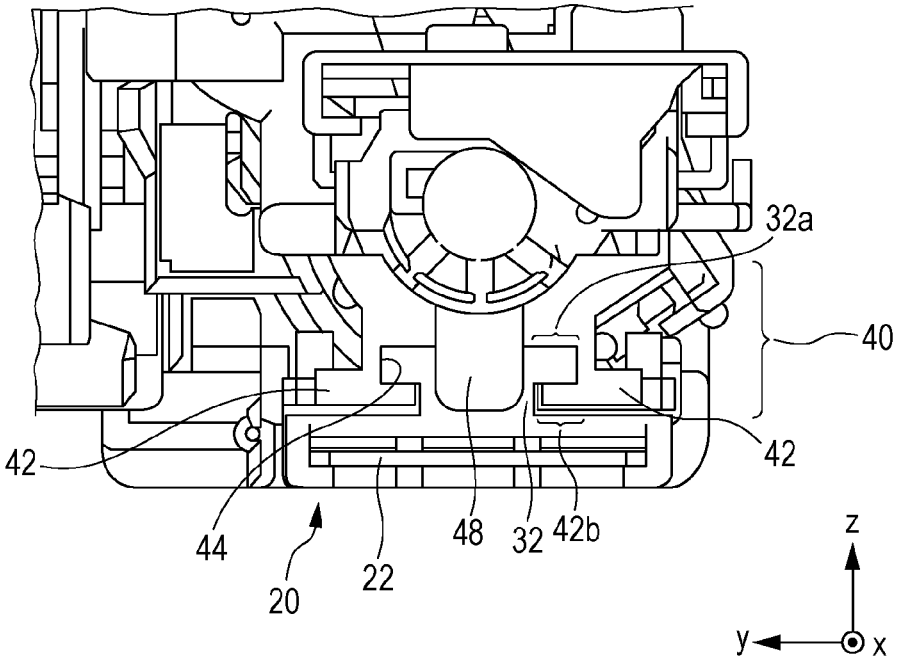

FIGS. 6A and 6B are side views of the process cartridge 12 in a state in which the memory unit 20 is held by the cartridge-side holding unit 40. FIG. 6A is a side view of the entire process cartridge 12. FIG. 6B is an enlarged view of part of the process cartridge 12 of FIG. 6A surrounded by a dotted box VIB.

As illustrated in FIG. 6B, the memory 22 is held by the cartridge-side holding unit 40 in a state in which the memory 22 is disposed in the memory unit 20. Specifically, the projection 32 of the memory unit 20 is inserted into the groove portions 44 formed by the rail portions 42 of the cartridge-side holding unit 40 from the negative x axis direction side of the groove portions 44. Thus, the flange portions 42*b* of the rail portions 42 and the flange portions 32*a* of the projection 32 are hooked onto one another, thereby the memory unit 20 is held by the cartridge-side holding unit 40 without dropping of the memory unit 20 due to gravity.

In a state in which the projection 32 is only hooked on the groove portions 44, the memory unit 20 is freely movable relative to the cartridge-side holding unit 40 in the x axis direction. Since both ends of each of the rail portions 42 in the x axis direction are open, the memory unit 20 freely movable in the x axis direction may drop during, for example, transfer of the process cartridge 12. In order to address this, a movement limiting mechanism that limits the movement of the memory unit 20 in the x axis direction is provided according to the present exemplary embodiment.

The relative movement of the memory unit 20 in the positive x axis direction is limited by the projecting block 48. That is, by bringing the projection 32 of the memory unit 20 inserted into the groove portions 44 into contact with the projecting block 48, the movement of the memory unit 20 in the positive x axis direction is limited.

The relative movement of the memory unit 20 in the negative x axis direction is realized by cooperation of the hook portions 46 of the cartridge-side holding unit 40 and the side wall portions 34 of the memory unit 20.

Figure 7A:
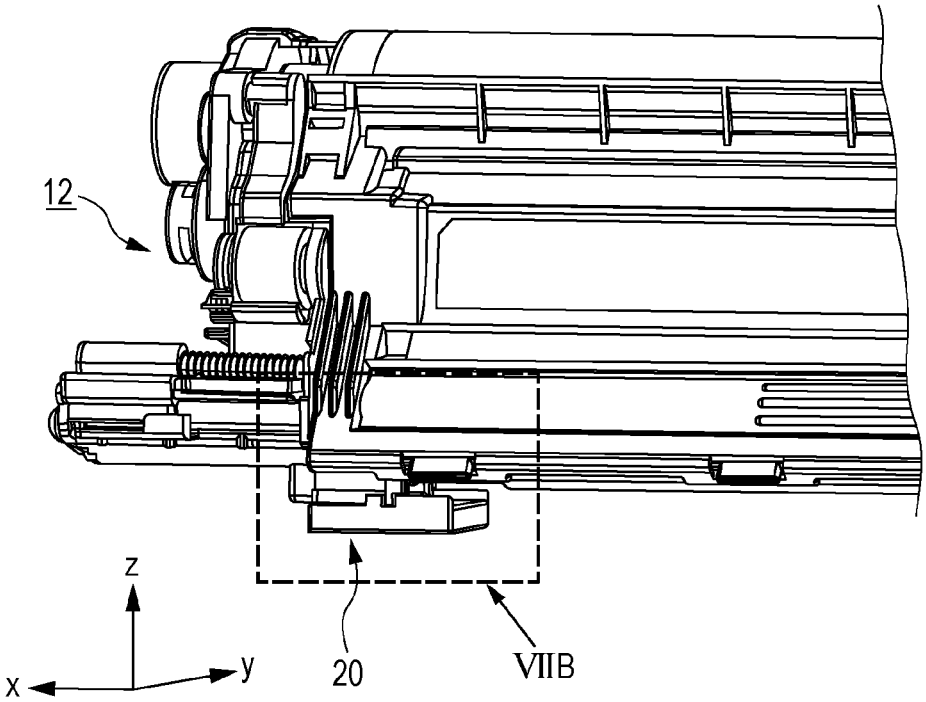
FIGS. 7A and 7B are perspective views of the process cartridge and the memory unit attached to the process cartridge.
Figure 7B:
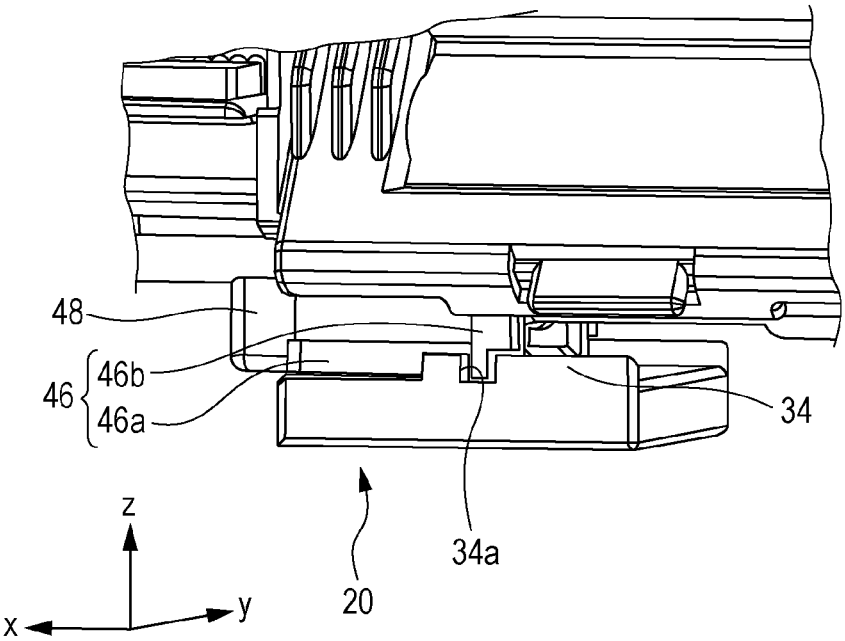

FIGS. 7A and 7B are perspective views of the process cartridge 12 in the state in which the memory unit 20 is held by the cartridge-side holding unit 40. FIG. 7A is a perspective view of an end portion of the entire process cartridge 12 in the x axis direction on a body side. FIG. 7B is an enlarged view of part of the process cartridge 12 of FIG. 7A surrounded by a dotted box VIIB. As illustrated in FIG. 7B, when the projection 32 (see FIG. 4A) is inserted into the groove portions 44 (see FIG. 5B), each of the side wall portions 34 of the memory unit 20 is positioned on the y axis outer side of a corresponding one of two hook portions 46. When the projection 32 is pushed in the positive x axis direction to a position near a position where the projection 32 is brought into contact with the projecting block 48, the claws 46*b* projecting toward the y axis outer sides from the hook portions 46 are fitted into the notch portions 34*a* of the side wall portions 34. By hooking of the claws 46*b* and the notch portions 34*a* on one another, the movement of the memory unit 20 in the negative x axis direction is limited. Thus, the lock mechanism is configured with which the movement of the memory unit 20 in the negative x axis direction relative to the process cartridge 12 is limited by the side wall portions 34 and the hook portions 46.

As described above, the memory unit 20 is held by the cartridge-side holding unit 40, thereby being attached to the process cartridge 12. The cartridge-side holding unit 40 holds the memory unit 20 at least in a state in which the process cartridge 12 is not inserted into the apparatus body. During the attachment and detachment operations of the process cartridge 12, the memory unit 20 is moved together with the process cartridge 12.

The Structure of a Body Side Holding Unit

Figure 8A:
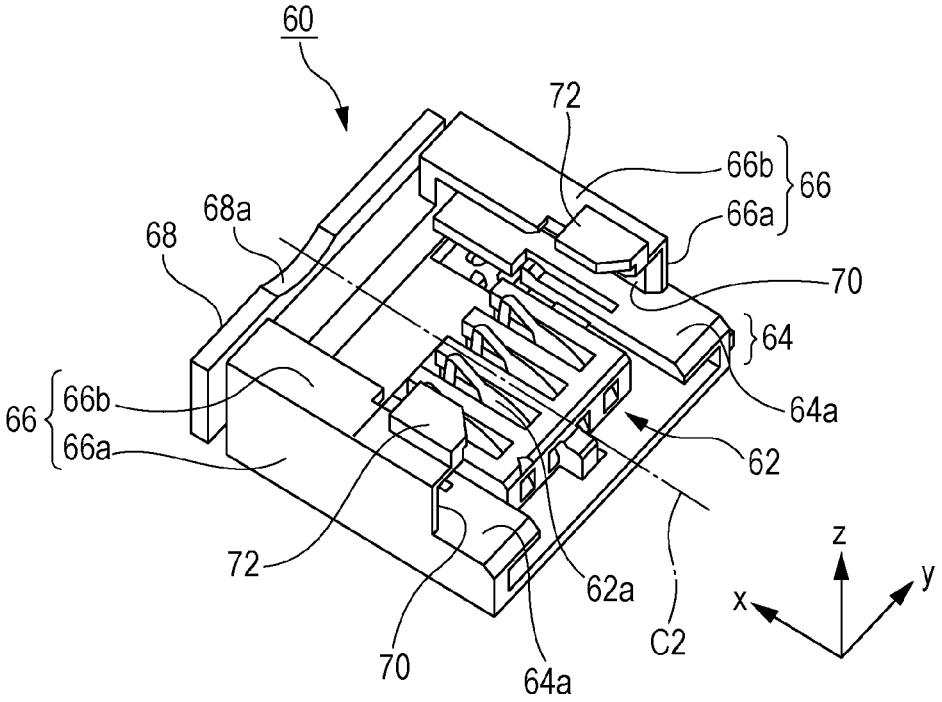
FIGS. 8A and 8B are a perspective view and a side view of a body-side holding unit.
Figure 8B:
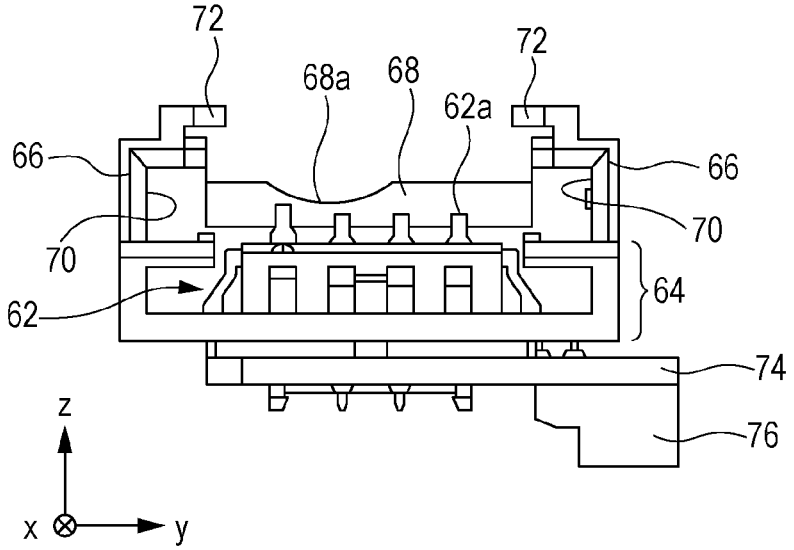

FIGS. 8A and 8B are a perspective view and a side view of a body-side holding unit 60 that is provided on the apparatus body side and holds the memory unit 20 transferred from the cartridge-side holding unit 40. FIG. 8A is a perspective view of the body-side holding unit 60 seen from above, and FIG. 8B is a side view of the body-side holding unit 60 seen from an x axis outer side.

The body-side holding unit 60 includes a base portion 64, side portions 66, a rear portion 68, and contact portions 72. The side portions 66 are provided along both ends of the base portion 64 in the y axis direction. The rear portion 68 is provided along an end portion of the base portion 64 on the positive x axis direction side. The contact portions 72 are provided on the upper side of the side portions 66. Here again, the sides in the y axis direction near a center line (dotted-chain line C2 of FIG. 8A) of the body-side holding unit 60 are referred to as "y axis inner sides", and sides in the y axis direction further from the center line C2 than the y axis inner sides are referred to as "y axis outer sides".

The base portion 64 has a substantially box shape and has an opening at a central portion of an upper surface 64*a* thereof in the y axis direction. A reading unit 62 that reads the information stored in the memory 22 is disposed in the base portion 64. The reading unit 62 includes plural contacts 62*a* positioned right below the opening of the upper surface 64*a* of the base portion 64. The contacts 62*a* are urged upward by forces applied by springs or the like.

Similarly to the rail portions 42 of the cartridge-side holding unit 40, the side portions 66 include wall-shaped leg portions 66*a* and plate-shaped flange portions 66*b*. The leg portions 66*a* extend upward substantially perpendicularly to the upper surface 64*a* of the base portion 64. The flange portions 66*b* extend parallel to the upper surface 64*a* toward the y axis inner sides from upper end portions of the leg portions 66*a*. That is, the yz sections of the side portions 66 that extend in the x axis direction have a substantially L shape. A U-shaped groove portions 70 are formed by the side portions 66 and the upper surface 64*a* of the base portion 64. As will be described later, the memory unit 20 is inserted into the groove portions 70. As illustrated in FIG. 8A, the groove portions 70 are open in the negative x axis direction. That is, an opening of the body-side holding unit 60 that receives the memory unit 20 is open in the negative x axis direction (that is, a direction opposite to a movement direction of the memory unit 20 moved as the attachment operation of the process cartridge 12 is performed).

The rear portion 68 having a wall shape is provided along the end portion of the base portion 64 on the positive x axis direction side. The memory unit 20 inserted into the groove portions 70 is brought into contact with the rear portion 68. The rear portion 68 has a notch portion 68*a*. As will be described later, the notch portion 68*a* is provided so as to avoid interference of the projecting block 48 of the process cartridge 12 with the rear portion 68 during the attachment and detachment operations of the process cartridge 12.

The contact portions 72 are provided on upper surfaces of the flange portions 66*b* of the side portions 66 such that the contact portions 72 project further to the y axis inner sides than end portions of the flange portions 66*b* on the y axis inner sides.

As illustrated in FIG. 8B, a junction board 74 is provided below the base portion 64. The reading unit 62 and a connector 76 are electrically joined to each other through the junction board 74. Wires connected to the controller or the like of the image forming apparatus 10 are connected to the connector 76. That is, the reading unit 62 and the controller of the image forming apparatus 10 are electrically connected to each other through the junction board 74 and the wires connected to the connector 76.

The body-side holding unit 60 is provided on the apparatus body side in a secured manner. The body-side holding unit 60 is disposed at a position separated from the printing operation position, that is, at a position separated from the process cartridge 12 in the attached state. Furthermore, the body-side holding unit 60 is disposed in a movement path of the memory unit 20 moved as the attachment operation of the process cartridge 12 is performed and disposed such that the opening of the body-side holding unit 60 that receives the memory unit 20 faces in a direction opposite to the movement direction of the memory unit 20 moved as the attachment operation is performed. Preferably, the position where the body-side holding unit 60 is attached is, for example, a housing chassis of the image forming apparatus 10 or the like where the body-side holding unit 60 is comparatively unlikely to vibrate in the image forming apparatus 10.

The Transfer of the Memory Unit Along with the Attachment Operation of the Process Cartridge Hereafter, a transfer operation of the memory unit 20 from the cartridge-side holding unit 40 to the body-side holding unit 60 is described with reference to FIGS. 9 to 12.

Figure 9:
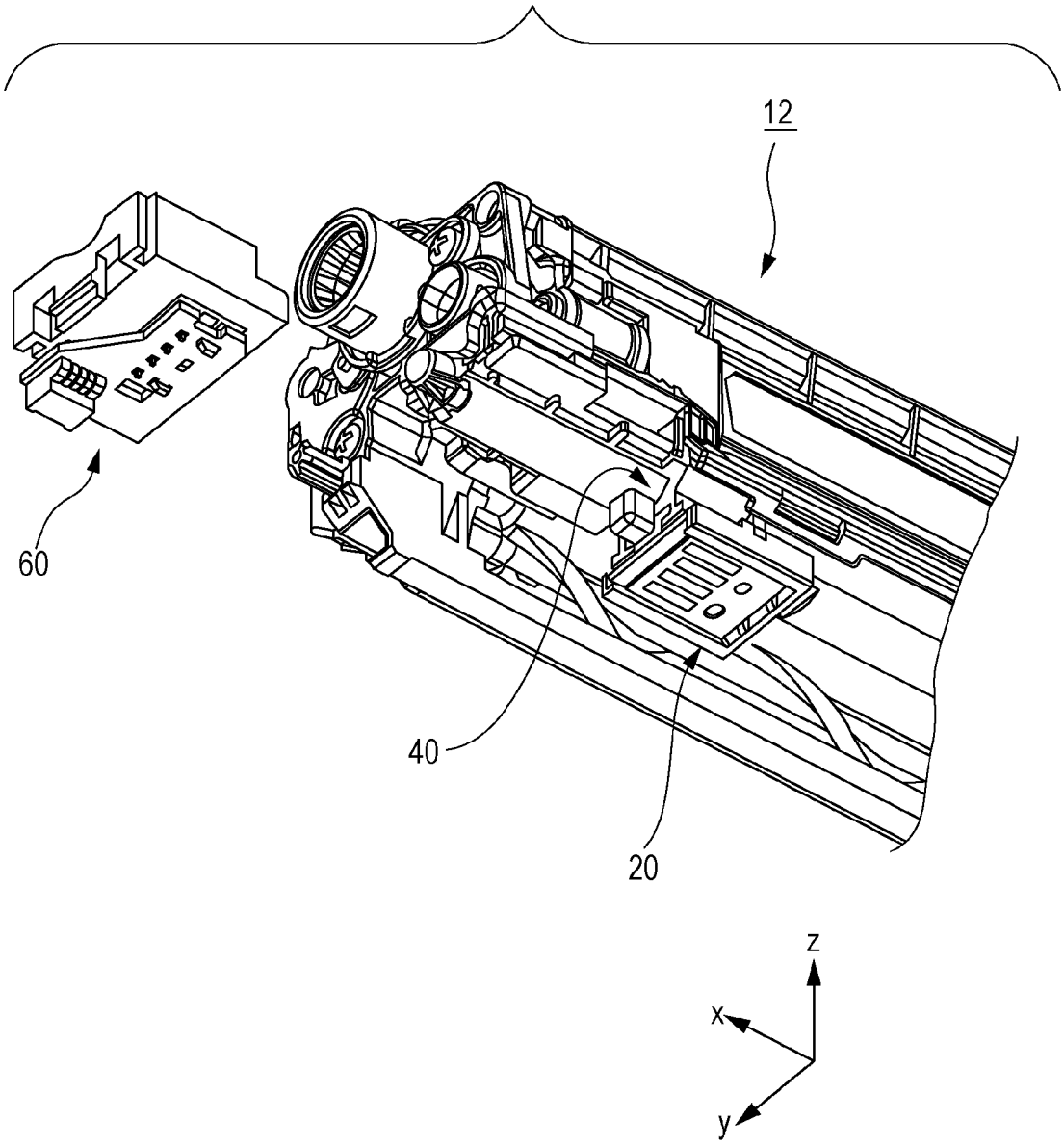
FIG. 9 is a first drawing illustrating how the memory unit is transferred to the body-side holding unit.

FIG. 9 illustrates the positional relationship between the memory unit 20 and the body-side holding unit 60 in the case where the process cartridge 12 is inserted into the image forming apparatus 10 and moved by a specified distance, that is, in the middle of the attachment operation. In this state, the memory unit 20 is still held by the cartridge-side holding unit 40.

Figure 10:
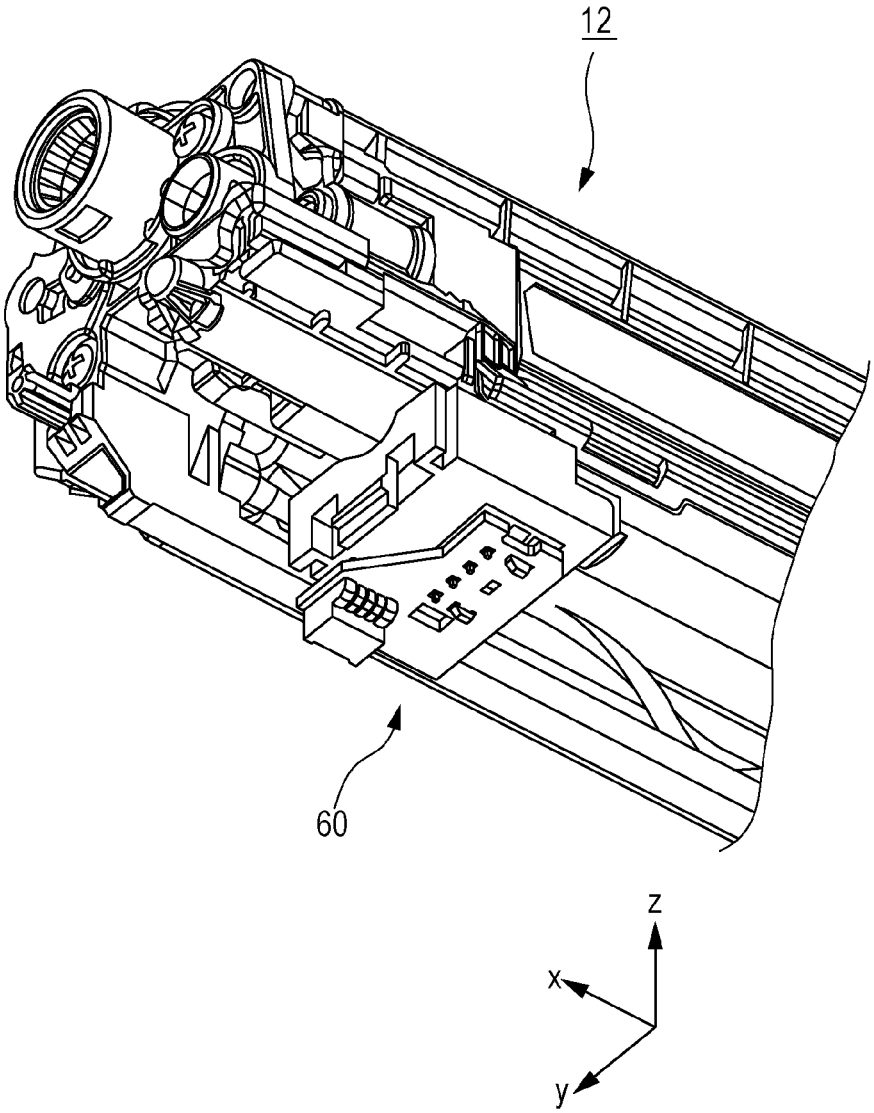
FIG. 10 is a second drawing illustrating how the memory unit is transferred to the body-side holding unit.

FIG. 10 illustrates a state in which the attachment operation of the process cartridge 12 has been advanced, that is, the process cartridge 12 has been moved further in the positive x axis direction from the state illustrated in FIG. 9. As described above, the body-side holding unit 60 is disposed in the movement path of the memory unit 20 moved as the attachment operation of the process cartridge 12 is performed, and the opening of the body-side holding unit 60 that receives the memory unit 20 is open so as to face in the negative x axis direction, that is, in the direction opposite to the movement direction of the process cartridge 12. Accordingly, the memory unit 20 is moved as the attachment operation of the process cartridge 12 is performed, thereby being inserted into the opening of the body-side holding unit 60.

Figure 11A:
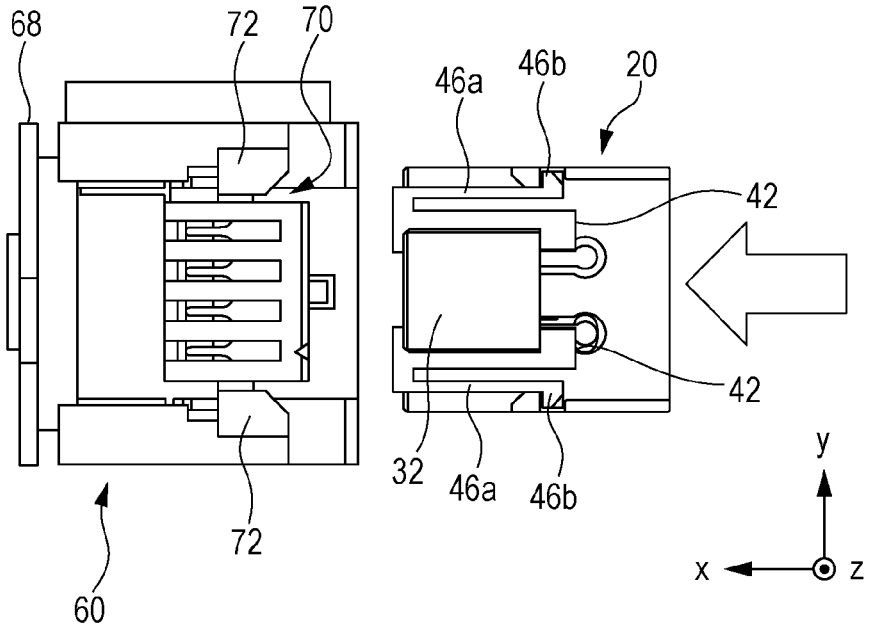
FIGS. 11A and 11B illustrate how a lock mechanism is released.
Figure 11B:
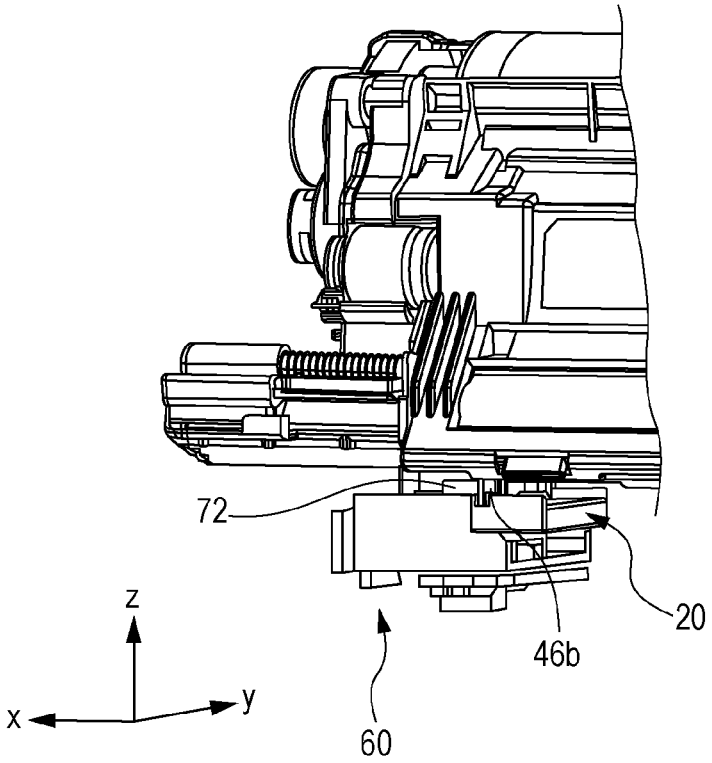

FIGS. 11A and 11B are other drawings illustrating how the memory unit 20 is inserted into and held by the body-side holding unit 60. FIG. 11A is a plan view of the body-side holding unit 60 and the memory unit 20. In FIG. 11A, only parts of the body-side holding unit 60, the memory unit 20, and the cartridge-side holding unit 40 are illustrated and the other parts of these components are omitted. FIG. 11B is a perspective view of the memory unit 20 inserted into the body-side holding unit 60.

The memory unit 20 is inserted into the groove portions 70 formed in the body-side holding unit 60 and moved in the positive x axis direction until the memory unit 20 is brought into contact with the rear portion 68. In this state, the memory unit 20 is still held also by the cartridge-side holding unit 40, that is, the memory unit 20 is held by both the cartridge-side holding unit 40 and the body-side holding unit 60.

The lock mechanism that limits the movement of the memory unit 20 in the negative x axis direction relative to the process cartridge 12 is released immediately before or when the memory unit 20 is brought into contact with the rear portion 68. Specifically, when the memory unit 20 is inserted into the body-side holding unit 60, the contact portions 72 provided in the body-side holding unit 60 are brought into contact with outer side surfaces of the arms 46*a* of the hook portions 46 of the cartridge-side holding unit 40 as illustrated in FIG. 11B. This causes the arms 46*a* to receive forces toward the y axis inner sides from the contact portions 72, and accordingly, the claws 46*b* provided at the tip ends of the arms 46*a* are also moved toward the y axis inner sides. As a result, the claws 46*b* are removed from the notch portions 34*a* provided in the side wall portions 34 of the memory unit 20. Thus, locking of the memory unit 20 is released. As described above, the contact portions 72 and the arms 46*a* of the hook portions 46 cooperate with one another to release the locking of the memory unit 20. When the lock mechanism is released, the memory unit 20 becomes movable in the negative x axis direction relative to the process cartridge 12.

Figure 12:
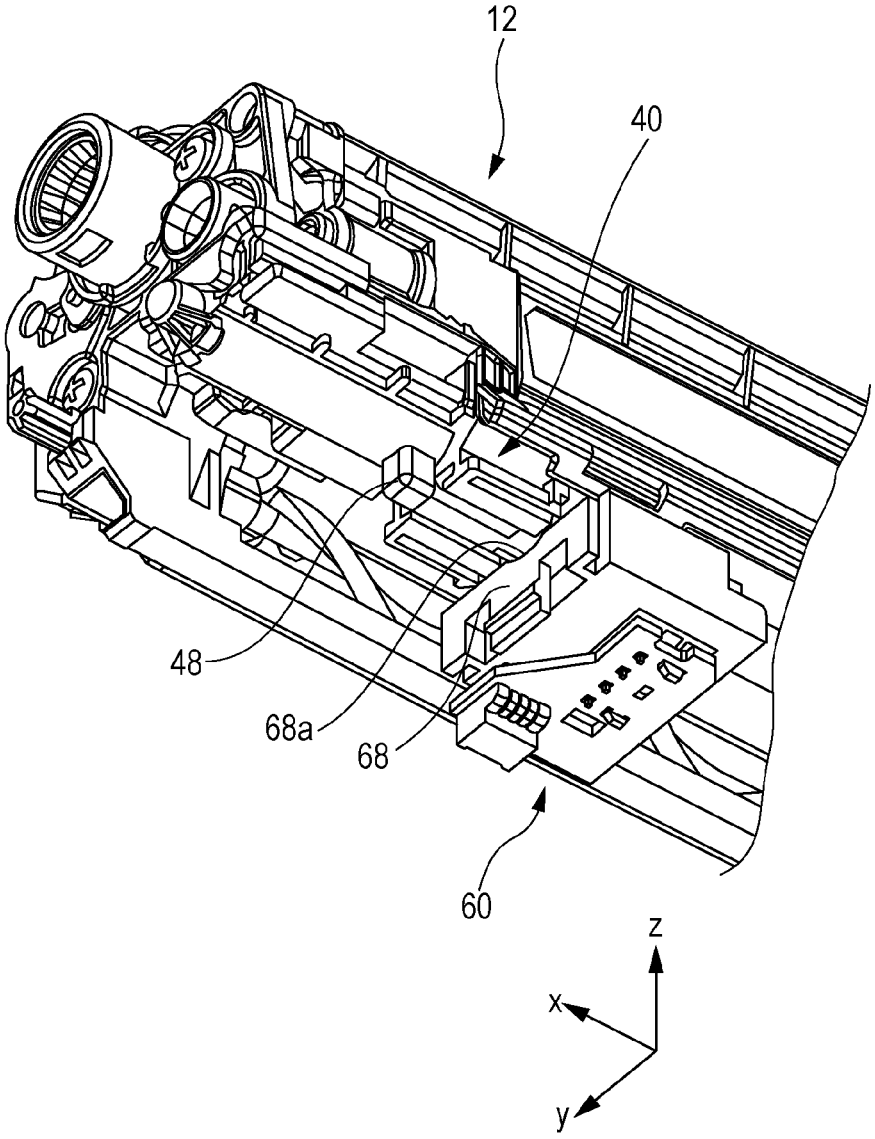
FIG. 12 illustrates the process cartridge disposed at a printing operation position.

FIG. 12 illustrates a state in which the process cartridge 12 is further moved in the positive x axis direction from the state illustrated in FIG. 10 and disposed at the printing operation position. Since the memory unit 20 is in contact with the rear portion 68 of the body-side holding unit 60 provided on the apparatus body side in a secured manner, the memory unit 20 is not moved further in the positive x axis direction when the process cartridge 12 is moved in the positive x axis direction with the locking of the memory unit 20 released. Since the cartridge-side holding unit 40 is moved in the positive x axis direction while the memory unit 20 is stationary, the memory unit 20 is moved in the negative x axis direction relative to the cartridge-side holding unit 40. As a result, the projection 32 of the memory unit 20 is removed from the end portions of the rail portions 42 on the negative x axis direction side, that is, the memory unit 20 is removed from the cartridge-side holding unit 40. When the process cartridge 12 is pushed into the attachment position, the memory unit 20 is completely removed from the cartridge-side holding unit 40 and held by the body-side holding unit 60. At this time, since the notch portion 68*a* is provided in the rear portion 68 of the body-side holding unit 60, the rear portion 68 does not interfere with the projecting block 48.

In this state, that is, in a state in which the memory unit 20 is held by the body-side holding unit 60, the printing operation is performed. In the state in which the memory unit 20 is held by the body-side holding unit 60, the contacts 26 of the memory 22 are in contact with the contacts 62*a* of the reading unit 62 provided in the body-side holding unit 60. This allows the image forming apparatus 10 to read content stored in the memory 22.

The Transfer of the Memory Unit Along with the Detachment Operation of the Process Cartridge The memory unit 20 that has been transferred from the cartridge-side holding unit 40 to the body-side holding unit 60 as the attachment operation of the process cartridge 12 is performed is transferred from the body-side holding unit 60 to the cartridge-side holding unit 40 as the process cartridge 12 is detached.

When transferring the memory unit 20 from the body-side holding unit 60 to the cartridge-side holding unit 40, the order of the above-described procedure of the transfer of the memory unit 20 from the cartridge-side holding unit 40 to the body-side holding unit 60 is substantially reversed.

Specifically, when the detachment operation is started and the process cartridge 12 is moved in the negative x axis direction, the projection 32 of the memory unit 20 held by the body-side holding unit 60 is initially inserted into the groove portions 44 (see FIG. 5B) formed by the rail portions 42 of the cartridge-side holding unit 40. In this state, the memory unit 20 is held by both the body-side holding unit 60 and the cartridge-side holding unit 40.

When the process cartridge 12 is further moved in the negative x axis direction, the projecting block 48 is brought into contact with the projection 32 of the memory unit 20, thereby pushing out the memory unit 20 in the negative x axis direction. As the memory unit 20 is moved due to this pushing out, the contact portions 72 (see FIG. 11A) of the body-side holding unit 60 are brought out of contact from the arms 46*a*, and the claws 46*b* are moved toward the y axis outer sides. This causes the claws 46*b* to be hooked again onto the notch portions 34*a* of the side wall portions 34 of the memory unit 20. Thus, the locking state is assumed.

After that, the process cartridge 12 continues to be moved in the negative x axis direction, thereby completely removing the memory unit 20 held by the cartridge-side holding unit 40 from the body-side holding unit 60.

Other Operations of the Exemplary Embodiment

While the printing operation is performed, the process cartridge 12 itself vibrates due to rotation of the rotating components such as a photosensitive drum and a developing roller disposed in the process cartridge 12. In particular, the position of the developing unit 18 relative to the photosensitive unit 16 is adjustable in the process cartridge 12. Thus, vibration is generated also by a positional adjustment operation of the developing unit 18. According to the present exemplary embodiment, the memory 22 is held by the body-side holding unit 60 provided on the apparatus body side during the printing operation. Thus, the memory 22 is not directly affected by the vibration generated by the process cartridge 12 during the printing operation. Accordingly, compared to the case where the memory 22 remains attached to the process cartridge 12, the vibration of the memory 22 during the printing operation may be reduced.

When the vibration of the memory 22 during the printing operation is reduced, the amount of friction between the contacts 26 of the memory 22 and the contacts on the apparatus body side is also reduced. Accordingly, compared to the case where the memory 22 remains attached to the process cartridge 12, the abrasion loss of the contacts 26 of the memory 22 may be reduced according to the present exemplary embodiment.

According to the present exemplary embodiment, the memory unit 20 attached to the process cartridge 12 is held by the body-side holding unit 60 during the printing operation. Thus, the cartridge-side holding unit 40 may be provided in any position of the process cartridge 12. For example, the cartridge-side holding unit 40 may be provided on the developing unit 18 side where the vibration is most likely to occur in the process cartridge 12. This allows the position to hold the memory unit 20 to be appropriately selected for convenience of layout of the components or convenience of allocation of the space in the image forming apparatus 10.

According to the present exemplary embodiment, the body-side holding unit 60 is disposed in the movement path of the memory unit 20 moved as the attachment operation of the process cartridge 12 is performed. In addition, the opening of the body-side holding unit 60 is open in the direction opposite to the movement direction of the memory unit 20. Thus, the memory 22 is held by the body-side holding unit 60 as the attachment operation of the process cartridge 12 is performed. That is, the user may transfer the memory 22 from the cartridge-side holding unit 40 to the body-side holding unit 60 while a separate operation is not required. Furthermore, with this structure, it is not necessarily required that a separate structure for transferring the memory 22 be provided.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an apparatus body;

a cartridge attachable to and detachable from the apparatus body;

a storage medium in which information relating to the cartridge is stored;

a cartridge-side holding device that is provided on the cartridge and that is configured to, when the cartridge is in a non-attached state in which the cartridge is not attached to the apparatus body, hold the storage medium;

a body-side holding device that is provided on the apparatus body and that is configured to, when the cartridge is in an attached state in which the cartridge is disposed at an operation position in the apparatus body, hold the storage medium that has been transferred from the cartridge-side holding device such that the cartridge-side holding device no longer holds the storage medium; and a reading device configured to read the information from the storage medium held by the body-side holding device.

2. The image forming apparatus according to claim 1, wherein the storage medium is transferred from the cartridge-side holding device to the body-side holding device as an attachment operation of the cartridge to the apparatus body is performed.

3. The image forming apparatus according to claim 2, wherein the cartridge-side holding device is allowed to release holding of the storage medium when the storage medium is moved relative to the cartridge in a direction opposite to a movement direction of the cartridge during the attachment operation, wherein the body-side holding device is provided in a movement path in which the storage medium is moved as the attachment operation is performed, wherein the body-side holding device has an opening that is open in a direction opposite to a movement direction of the storage medium in which the storage medium is moved as the attachment operation is performed, wherein the storage medium held by the cartridge-side holding device is inserted into the body-side holding device through the opening when the storage medium is moved as the attachment operation is performed, and wherein the storage medium is transferred from the cartridge-side holding device to the body-side holding device by releasing the holding of the storage medium by the cartridge-side holding device.

4. The image forming apparatus according to claim 3, wherein the cartridge-side holding device includes a movement limiting device that limits a movement of the storage medium relative to the cartridge in the direction opposite to the movement direction of the cartridge during the attachment operation, and wherein the body-side holding device includes a limitation releasing device that releases limitation by the movement limiting device when the storage medium is inserted into the opening of the body-side holding device.

5. A cartridge that is attachable to and detachable from an apparatus body of an image forming apparatus, the cartridge comprising:

a cartridge-side holding device that is configured to, when the cartridge is in a non-attached state in which the cartridge is not attached to the apparatus body, hold a storage medium in which information relating to the cartridge is stored;

wherein the cartridge-side holding device is configured to be inserted into a body-side holding device provided on the apparatus body as the cartridge is moved toward an attached state in which the cartridge is disposed at an operation position in the apparatus body, and wherein the cartridge-side holding device is configured to, when the cartridge-side holding device is inserted into the body-side holding device as the cartridge is moved toward the attached state in which the cartridge is disposed at the operation position, transfer the storage medium to the body-side holding device such that, when the cartridge is in the attached state in which the cartridge is disposed at the operation position, the cartridge-side holding device no longer holds the storage medium.

6. An image forming apparatus comprising:

an apparatus body that is attachable to and detachable from a cartridge; and a body-side holding device that is configured to receive a cartridge-side holding device provided on the cartridge, the cartridge-side holding device holding a storage medium, as the cartridge-side holding device is inserted into the body-side holding device, when the cartridge is moved toward an attached state in which the cartridge is disposed at an operation position in the apparatus body from a non-attached state in which the cartridge is not attached to the apparatus body, wherein the storage medium stores information relating to the cartridge, wherein the body-side holding device is configured to, when the cartridge-side holding device is inserted into the body-side holding device as the cartridge is moved toward the attached state in which the cartridge is disposed at the operation position, transfer the storage medium to the body-side holding device such that, when the cartridge is in the attached state in which the cartridge is disposed at the operation position, the body-side holding device holds the storage medium and the cartridge-side holding device no longer holds the storage medium.

7. The image forming apparatus according to claim 6, further comprising a reading device configured to read the information from the storage medium held by the body-side holding device.

* * * * *